US005857295A

United States Patent [19]

Mikawa

[11] Patent Number: 5,857,295

[45] Date of Patent: Jan. 12, 1999

[54] ADJUSTABLE ROOF TIE

[75] Inventor: Yoshinori Mikawa, Hokkaido, Japan

[73] Assignee: Canadoo Enterprises Inc., Vancouver, Canada

[21] Appl. No.: 874,989

[22] Filed: Jun. 11, 1997

[30] Foreign Application Priority Data

May 9, 1997 [CA] Canada ..... 2204937

[51] Int. Cl.[6] ..... E04B 7/04

[52] U.S. Cl. ..... 52/92.2; 52/712; 52/656.9

[58] Field of Search ..... 52/92.2, 702, 712, 52/656.9, 713; 403/232.1, 59, 60, 72, 73

[56] References Cited

U.S. PATENT DOCUMENTS

| | | | |
|---|---|---|---|
| 4,449,335 | 5/1984 | Fahey | 52/92.2 |
| 4,714,372 | 12/1987 | Commins | 403/400 |
| 5,217,317 | 6/1993 | Young | 52/712 X |
| 5,230,198 | 7/1993 | Callies | 52/92.2 X |
| 5,303,520 | 4/1994 | Gozdziak | 52/713 X |
| 5,393,162 | 2/1995 | Nissen | 403/154 |

*Primary Examiner*—Creighton Smith
*Attorney, Agent, or Firm*—Natan Epstein; Beehler & Pavitt

[57] ABSTRACT

An adjustable tie includes a rafter holder with a partially raised bottom surface, an angular plate, and hinge means between them. The holder and angular plate are rotatable about the longitudinal axis of the hinge.

3 Claims, 3 Drawing Sheets

ADJUSTABLE ROOF TIE

TECHNICAL FIELD OF THE INVENTION

This invention relates to roof ties. More particularly, the invention relates to an adjustable coupling arrangement to connect roof construction members such as purlins, joists, rafters and beams.

BACKGROUND ART

A conventional means of securing members in a roof construction is to nail an angular steel plate or tie to two members, for example a rafter and a beamon the top plate. The tie is typically a rigid angular strip of metal extending between and fastened to both members such that they can not separate. Conventional ties use a strip of metal bent into at least two planes intersecting at right angles. Where roofing members intersect at oblique angles the connection must be strengthened by cutting or shaping one of the intersecting members, usually the rafter. Alternatively, the rafter must be buttressed. Moreover, this must normally be done at a high elevation as the roof is being constructed.

Another problem with most prior art ties is that they are not adjustable and therefore can not accommodate varying angles between the rafters and the top plate without significant on site cutting of the wood or other shaping of the metal tie.

It is therefore a general object of the present invention to provide an improved tie which will obviate the above mentioned disadvantages, notably the problem of on site adjustability, and the need for a joint which is adjustable for varying angles of intersection between the rafters and the top plate.

SUMMARY OF THE INVENTION

The adjustable tie according to the invention includes a channel-shaped rafter holder connected by hinge means to an angular plate. In roofing construction, the angular plate may be affixed to a top plate, then a rafter inserted in the holder. The rafter position is then easily adjusted to bring the opposite end in contact with the central beam. This device and method allows quick and simple installation.

Accordingly, in one aspect, the invention comprises a tie for connecting members comprising a means for retaining a first beam, an angular plate and means for rotatably coupling said retaining means to said angular plate. Preferably the retaining means is channel-shaped and the angular plate comprises two perpendicular plates. The channel-shaped holder may have a bottom surface which has a longitudinal central raised portion which provides structural strength to the means for rotatably coupling the holder to the angular plate. The central portion also provides a platform for the lower surface of the roofing member inserted in the retaining means such that the roofing member does not interfere with the rotation of the retaining means.

In another aspect of the invention the means for rotatably coupling the angular plate and retaining means comprises a spindle. Three hollow cylinders are disposed along the apex of the angular plate to allow insertion of a spindle. The spindle may be inserted through the hollow cylinders and through apertures in the retaining means and the angular plate are rotatable about the spindle.

BRIEF DESCRIPTION OF THE DRAWINGS

The invention may be more fully appreciated by reference to the following description of the preferred embodiment and by reference to the drawings thereof in which.

DETAILED DESCRIPTION OF BEST MODE AND PREFERRED EMBODIMENT OF THE INVENTION

Figure 1:
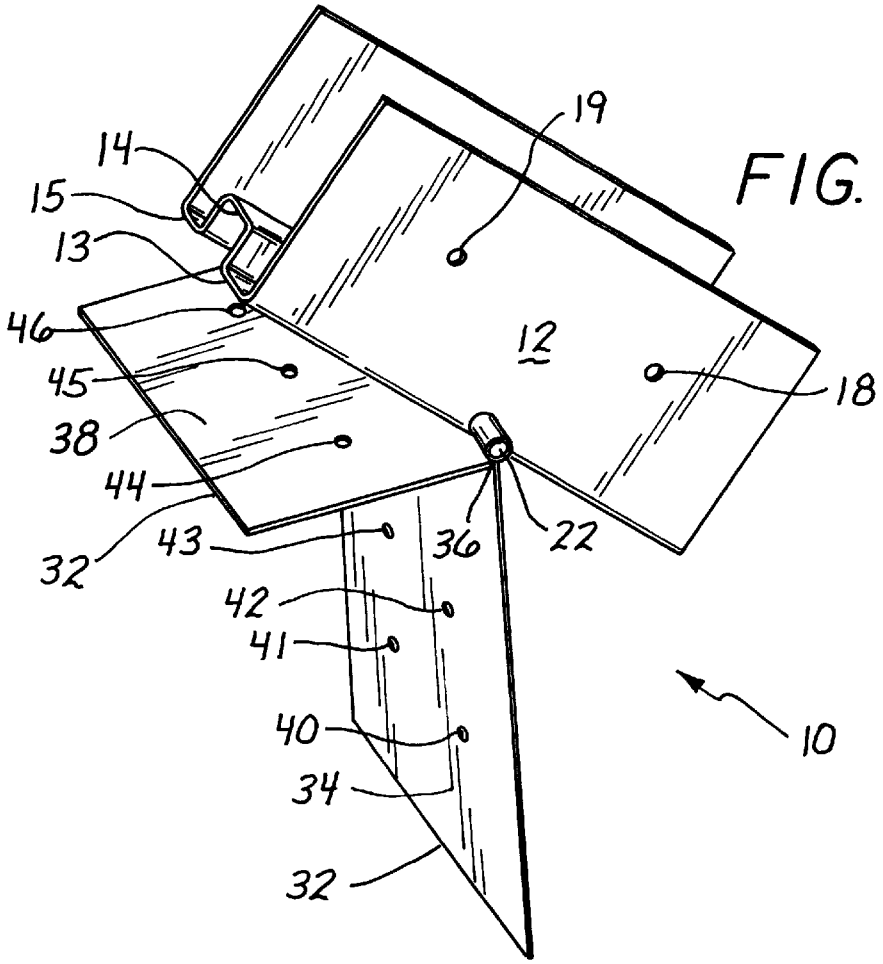
FIG. 1 is a left perspective view of an adjustable tie according to the invention.
Figure 2:
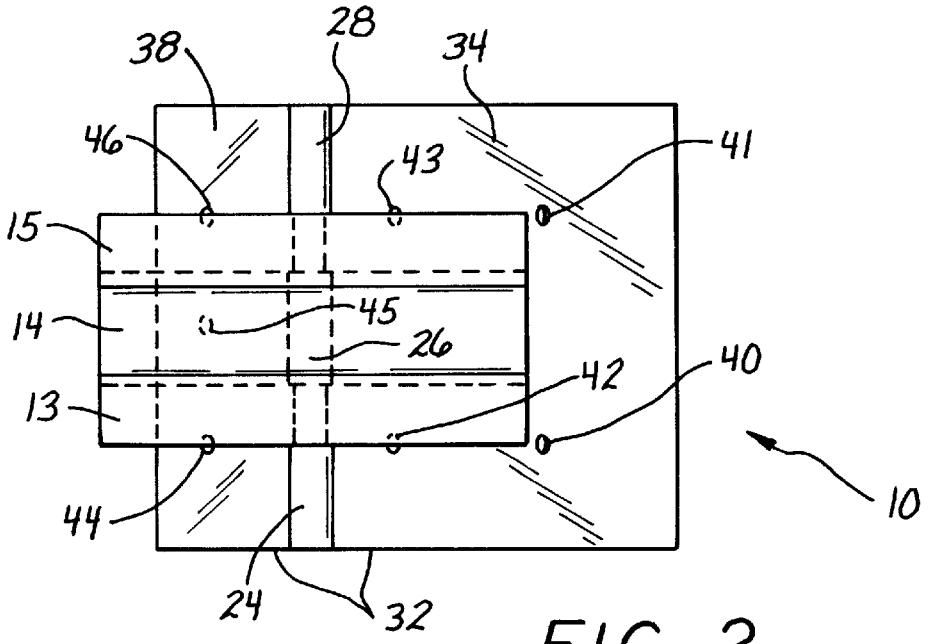
FIG. 2 is a plan view of an adjustable tie according to the invention.
Figure 3:
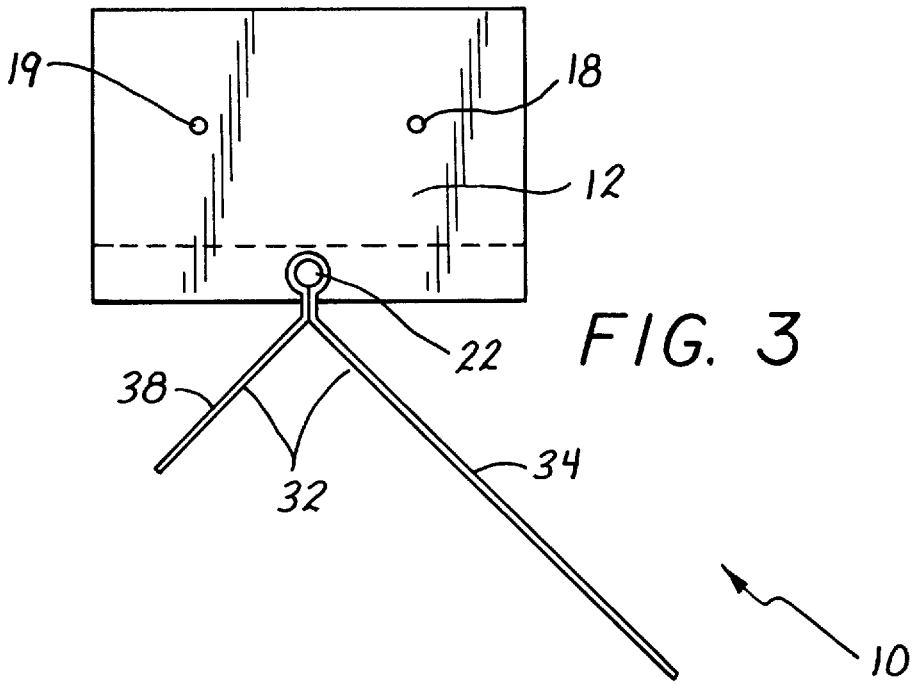
FIG. 3 is a side view of an adjustable tie according to the invention.
Figure 4:
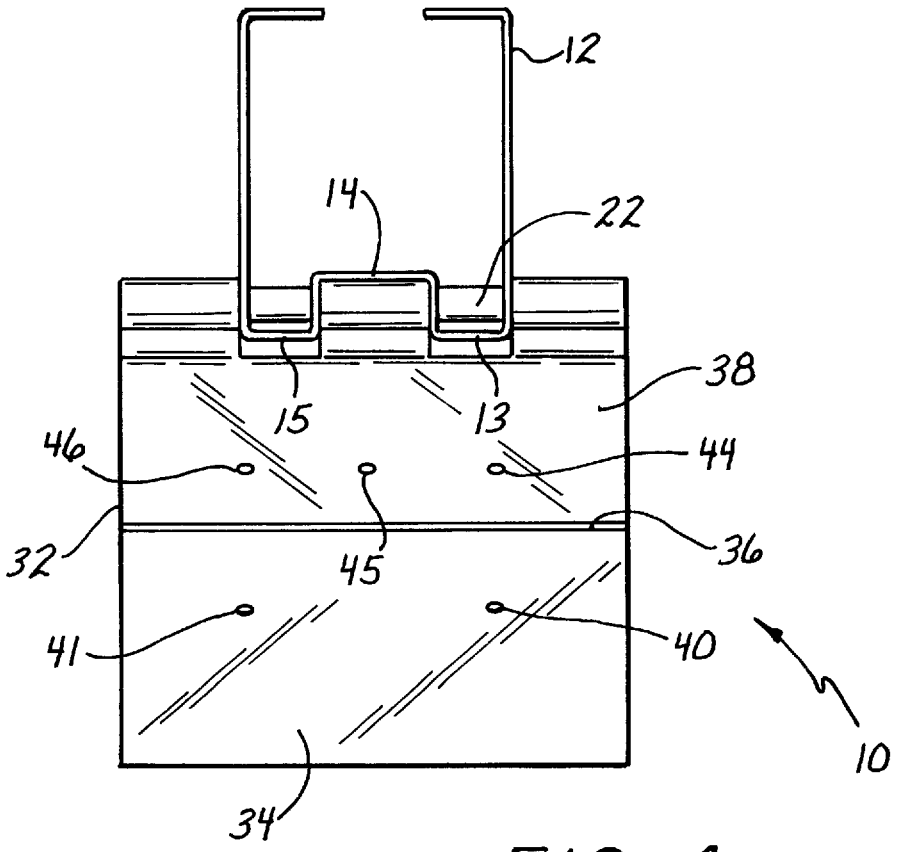
FIG. 4 is an end view of an adjustable tie according to the invention.

The preferred embodiment of the adjustable tie according to the invention is depicted in FIG. 1 wherein the tie in its entirety is designated by the numeral 10. The tie 10 includes a generally channel-shaped holding means (referred to for simplicity as a holder) 12, a spindle 22, and an angular plate 32. The holder 12 is attached to the angular plate 32 by means of the spindle 22. Both the holder 12 and the angular plate 32 are rotatable about the axis of the spindle 22.

Figure 5:
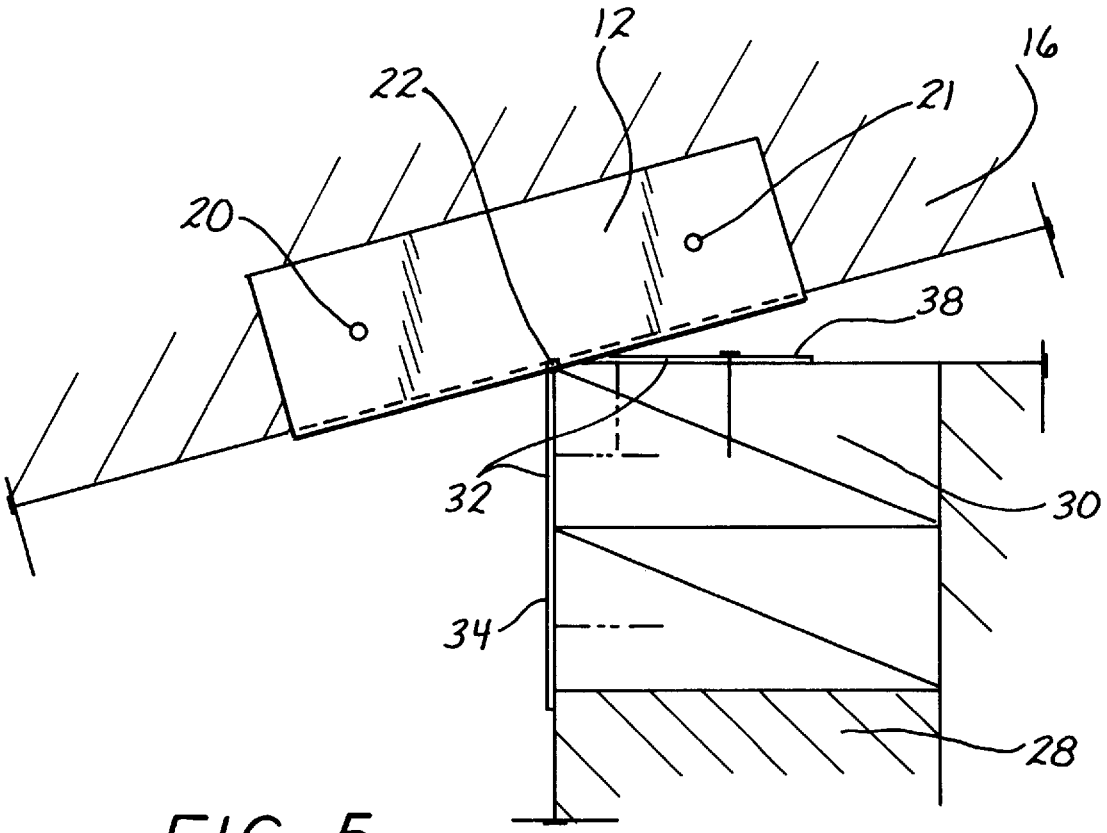
FIG. 5 is a profile view of an adjustable tie as installed in one embodiment according to the invention.

Referring now to FIG. 5, the angular plate 32 may be attached to the top plate 30 of a wall 28. The holder 12 then typically receives a rafter which is rotated about the axis of the spindle 22 until the far end of the rafter is inserted in an adjustable roof tie attached to a central beam.

Referring generally to FIGS. 1, 2, 3, and 4, the holder 12 has a generally channel-shaped cross-section such that it is open on its ends and at its top. A roofing member, typically a rafter 16, is inserted in the holder. The base of the holder 12 may be crenellated such that there is a longitudinal left base portion 13, a central raised portion 14, and a right base portion 15. The central portion 14 provides structural strength to the means for rotatably coupling the holder to the angular plate 32. The central portion 14 also provides a platform for the lower surface of the roofing member 16 inserted in the retaining means 12 such that the roofing member 16 does not interfere with the rotation of the retaining means 12. The right and left sides of the holder 12 has a plurality of holes 18, 19, 20, 21, such that fasteners may be inserted to secure the rafter.

The spindle 22 is a cylinder of a length approximately equal to the width of the angular plate 32. The spindle 22 acts as a hinge between the holder and the angular plate 32.

The angular plate 32 consists of a back portion 34 which is generally rectangular in shape and a top portion 38 which is generally square in shape. An edge of the back portion intersects a short edge of the top portion at an angle of 90 degrees thereby forming a ridge 36. Three hollow cylinders 24, 26, 28 of an interior diameter sufficient to allow insertion of the spindle 22 are mounted longitudinally and concentrically on the ridge 36. The first cylinder 24 extends inwardly from the left edge of the ridge 36. The third cylinder 28 extends inwardly from the inwardly from the right edge of the ridge 36. The second cylinder 26 is centered on the ridge with a space between its outer edges and those of the first cylinder 24 and the third cylinder 28 such that the left base portion 13 and right base portion 15 of the holder 12 may be inserted. A plurality of holes are drilled or punched in both the back 34 and top portions 38 of the angular plate to allow the insertion of fasteners.

The left 13 and right 15 base portions of the holder 12 are inserted between the first 24 and second 26 cylinders and the second 26 and third 28 cylinders respectively. The spindle 22 is inserted in a hole in the third cylinder 28, the right base portion 15, the second cylinder 26, the left base portion 13, and the first cylinder 24. The end portions of the spindle 22 are of a diameter greater than that of the holes in the holder 12 and the interior diameter of the cylinders 24, 26, 28 on the angular plate 32 such that the spindle 22 can not be removed.

During installation for example in standard roof construction, use of the adjustable tie 10 obviates cutting and sizing of rafters 16 on-site to fit the top plate 30 or beam. The back portion 34 of the angular plate 32 is attached to the side of the longitudinal framing member or members (usually a top plate 30) by inserting fasteners, usually nails in the holes 40, 41, 42, 43. The top portion 38 of the angular plate 32 will then be abutting the top of the longitudinal framing member 30 and is also attached by inserting fasteners in the holes 44, 45, 46. A rafter 16 or transverse roofing member is then inserted in the holder 12 and held in place by inserting fasteners through the holes in the left 18, 19 and right sides 20, 21 of the holder 12 and into the rafter 16. The rafter 16 may now be rotated about the axis of the spindle 22. The far end of the rafter 16 may then be attached to the beam or other longitudinal member by the same method. This obviates the need to cut the undersurface of the rafters 16 to abut the longitudinal members as they naturally intersect at oblique angles.

Attaching rafters 16 with the adjustable tie 10 simplifies the work and lowers the skill requirement of the installer (framer). As no cutting is required the installation is rendered safer, particularly as installation must be performed at high elevations and often in adverse weather. The end result is that considerable time and money are saved with the use of adjustable ties 10. Simplifying the use of ties tends to reduce errors by the framers and therefore ensure greater structural strength.

It will be appreciated that the angular plate 32 and holder 12 may be of various different sizes depending on the size of roofing members with which they are used. The angular plate 32 may also be varied to contact three roofing member surfaces. It will further be appreciated by those skilled in the art that other variations of the preferred embodiment may also be practised without departing from the scope of the invention.

What is claimed is:

1. A tie for connecting roofing members comprising:

retaining means adapted for attaching said tie to a first roofing member, wherein said retaining means has a channel-shaped cross section and a bottom surface which comprises a raised portion;

an angular plate for attachment to at least a second roofing member; and, means for rotatably coupling said retaining means to said angular plate.

2. An adjustable tie as in claim 1 wherein said means for rotatably coupling comprises a spindle inserted through a hollow cylinder extending along the longitudinal axis of rotation of said means for rotatably coupling and through said raised portion said retaining means is rotatable about said spindle.

3. A tie for connecting roofing members comprising:

retaining means adapted for attaching said tie to a first roofing member and having a channel shaped cross section and apertures therein;

an angular plate for attachment to at least a second roofing member, said angular plate consisting of at least two perpendicular plates defining an apex between them;

three hollow cylinders mounted along the apex of the angular plate; and, means for rotatably coupling said retaining means to said angular plate, including spindle inserted through said apertures and said hollow cylinders.

* * * * *

UNITED STATES PATENT AND TRADEMARK OFFICE

CERTIFICATE OF CORRECTION

PATENT NO. : 5,857,295

DATED : January 12, 1999

INVENTOR(S) : Yoshinori Mikawa

It is certified that error appears in the above-identified patent and that said Letters Patent is hereby corrected as shown below:

On the title page, item [30], In the Foreign Application Priority Data, insert the Japanese Priority Data as follows:

-- November 13, 1996 [JP] Japan .....U-H8-1101 --

Signed and Sealed this
First Day of February, 2000

*Attest:*

*Attesting Officer*

Q. TODD DICKINSON

*Acting Commissioner of Patents and Trademarks*